United States Patent [19]

Scott

[11] 3,994,699

[45]*Nov. 30, 1976

[54] FUEL COMPOSITIONS USEFUL FOR GAS TURBINES AND PROCESS FOR THE COMBUSTION OF SUCH FUEL COMPOSITIONS

[75] Inventor: James F. Scott, Ridgefield, Conn.

[73] Assignee: The Perolin Company, Inc., Wilton, Conn.

[ * ] Notice: The portion of the term of this patent subsequent to June 18, 1991, has been disclaimed.

[22] Filed: June 13, 1974

[21] Appl. No.: 479,099

Related U.S. Application Data

[63] Continuation-in-part of Ser. No. 281,311, Aug. 17, 1972, Pat. No. 3,817,722.

[52] U.S. Cl. ..... 44/76; 44/51; 44/68; 44/DIG. 3

[51] Int. Cl.[2] ..... C10L 1/28

[58] Field of Search ..... 44/DIG. 3, 59, 68, 76

[56] References Cited

UNITED STATES PATENTS

| | | | |
|---|---|---|---|
| 2,843,200 | 7/1958 | Rocchini | 44/68 X |
| 3,003,857 | 10/1961 | Carls | 44/DIG. 3 |
| 3,316,070 | 4/1967 | Scott | 44/51 |
| 3,817,722 | 6/1974 | Scott | 44/76 |

FOREIGN PATENTS OR APPLICATIONS

| | | | |
|---|---|---|---|
| 744,141 | 2/1956 | United Kingdom | 44/DIG. 3 |
| 761,360 | 11/1956 | United Kingdom | 44/DIG. 3 |
| 761,378 | 11/1956 | United Kingdom | 44/DIG. 3 |
| 764,752 | 1/1957 | United Kingdom | 44/DIG. 3 |

*Primary Examiner*—Allen B. Curtis
*Assistant Examiner*—Y. Harris-Smith
*Attorney, Agent, or Firm*—Cooper, Dunham, Clark, Griffin & Moran

[57] ABSTRACT

Gas turbine fuels, either ash-containing fuels having a high alkali metal content, such as greater than 5 ppm by weight sodium and/or potassium, or substantially ash-free fuels which are burned or combusted under conditions that alkali metal appears in the combustion products, are advantageously combusted in the presence of additive components consisting essentially of compounds of silicon and magnesium which form $SiO_2$ and MgO at fuel combustion temperatures, the proportions of said compounds being such as to provide a combined $SiO_2$ and MgO equivalent wherein the $SiO_2$:MgO ratio is greater than 2:1, the quantity of said additive components present during the combustion of said fuel being such as to provide a magnesium to vanadium weight ratio of at least 2:1 and a weight ratio of silicon to alkali metal of at least 2:1, preferably greater than 6:1.

20 Claims, No Drawings

FUEL COMPOSITIONS USEFUL FOR GAS TURBINES AND PROCESS FOR THE COMBUSTION OF SUCH FUEL COMPOSITIONS

This application is a continuation-in-part of my copending, coassigned patent application Ser. No. 281,311 filed Aug. 17, 1972, now U.S. Pat. No. 3,817,722. The disclosures of my above-identified patent are herein incorporated and made part of this disclosure.

This invention is directed to fuel compositions and processes for the combustion of fuels, particularly fossil fuels, such as petroleum fuels, and waste combustible matter utilized separately or in conjunction with fossil fuels. The practice of this invention is particularly applicable to fuels and the combustion of such fuels for the operation of gas turbines for power generation, propulsion systems, pipe line service and the like.

Magnesium-containing compounds have been employed as corrosion inhibition additives in connection with the combustion of non-distillate fuels containing ash or inorganic contaminants, particularly metal contaminants, for the operation of gas turbines. When such ash-containing fuels are employed as gas turbine fuels, it has heretofore been necessary to pretreat these fuels to reduce the alkali metal content thereof to a minimal level so as to produce in the combustion effluent resulting from the combustion of such fuels less than about 1.0 ppm alkali metal (sodium and/or potassium) and preferably below 0.5 ppm by weight. The removal of the alkali metal from the fuel and/or the avoidance of its presence in the combustion products when the fuel is employed to operate a gas turbine, employing magnesium as an additive, has heretofore been considered necessary in order to obtain high temperature corrosion protection of the metal alloys employed in the nozzles and blades of the turbine operating at a temperature of about 1,400° F. and higher.

While magnesium is generally accepted as an effective additive component in gas turbine fuels to reduce or avoid high temperature vanadium corrosion of the gas turbine blades, which becomes of primary importance at temperatures above 1,400° F., the effectiveness of magnesium as an additive is impaired by the presence in the fuel or in the combustion gas effluent of even small amounts of alkali metal, such as sodium, since with both sodium and vanadium present with the fuel, the ash formed tends to be high in corrosive, low melting sodium vanadates to the exclusion of magnesium, vanadates as vanadium selectively reacts with sodium rather than magnesium. Heretofore, it has not been possible to inhibit the tendency of sodium to form undesirable corrosive compounds in the presence of vanadium. Most important, moreover, is the inability of magnesium to provide effective protection against sodium sulfate attack of turbine blades and nozzles, commonly known as sulfidation, which has become a most serious, even devastating, problem at the present and proposed higher operating temperatures brought about by continued industry efforts to increase gas turbine output and efficiency. The presence of alkali metals in the combustion product also adversely affects the nature of turbine ash deposits resulting in increased fouling and constriction of flow of the combustion gas through the turbine, thereby causing a rapid decline in power output and increasing the necessity and/or frequency of water washing the turbine to remove such deposits so as to restore turbine output to original design rating.

It has been the practice heretofore when an ash-containing or alkali metal-containing fuel is combusted to generate a combustion effluent for the operation of a gas turbine to pretreat the fuel, such as by water washing, to effect removal of the alkali metal and water-soluble ash-forming compounds therefrom. Facilities for water washing fuels require considerable space and contribute significantly to overall plant installation cost. For example, in the water washing of such fuels, difficult to break water-in-oil emulsions are often formed. These emulsions require the use of de-emulsifying agents, usually together with centrifugal or electrostatic means or devices to complete the removal of the water phase containing the water-soluble salts extracted from the oil phase.

Alkali metal, such as sodium, may enter the combustion zone and the combustion products not only as a contaminant in the fuel but also as a contaminant in the combustion air, particularly in connection with the combustion of fuels in a marine installation, such as on board a vessel or in a harbor or other marine location. Alkali metal, such as sodium, may appear in the fuel combustion products due to the ingestion of airborne salt (NaCl) particles or airborne salt-containing mists. Heretofore, to avoid such alkali metal contamination, provisions had to be made to remove air-borne contaminants by coalescing and filtering devices. Another possible source of alkali metal contamination in connection with the operation of a gas turbine arises from the use of water injection into the primary combustion zone of the turbine for reduction of the nitrogen oxides emissions in the combustion effluents of the gas turbine operation, particularly when the water employed has alkali metal salts dissolved therein. The elimination of alkali metals, such as sodium, and other metals to provide substantially metal-free water or water of desired purity also require special pretreatment, such as demineralization or deionization.

In the A.S.M.E. publication by E. E. Krulls entitled "Gas Turbine Liquid Fuel Treatment and Analysis", Paper No. 74-GT-44, presented at the Gas Turbine Conference, Zurich, Switzerland, Mar. 31 – Apr. 4, 1974, there is presented a description of fuel treatment equipment including fuel washing and other factors related to the selection and treatment of the fuels for gas turbine operation. The disclosures of this paper are herein incorporated and made part of this disclosure.

As indicated hereinabove, the problems encountered in burning ash-containing fuels, particularly sodium-containing fuels, for gas turbine operation and the use of magnesium as an additive component in such fuels so as to improve gas turbine blade life are well known. The current practice of employing magnesium as an additive makes it mandatory to reduce the sodium in fuels to a minimal level as a prerequisite to obtaining effective high temperature corrosion protection of turbine hot-section alloys, e.g., nozzles and blades, operating at temperatures of 1,400° F. or higher. Fuel washing for removal of sodium is considered absolutely essential to provide fuels suitable for use in gas turbines in all cases except distillates, and is a major deterrent to the utilization of low cost ash-containing oils and to the wide-spread employment of gas turbines for power generation in such fields as utilities, manufacturing and process industries, transporation and the like. Fuel washing facilities are expensive and add considerably to the installed cost/KW hr. of heavy oil burning turbine installations, increasing capitalized cost, space requirements (of particular importance in marine application), complexity of operation, and operating costs including increased man-power requirements. Hence, the simplification or elimination of such washing facilities would obviously constitute an improvement of major importance and a means of substantially improving the competitive position of the gas turbine vis-a-vis diesel and steam generating systems which do not require fuels conforming to such restrictive alkali metal specifications. An improvement in the process for burning fuels containing significant amounts of alkali metal which would permit satisfactory operation with fuels "as received", containing both vanadium and sodium, would have a profound effect on the market potential for gas turbines.

Also, the need for effective high temperature corrosion inhibitors and ash-modifying agents to avoid difficulty in the handling of alkali metal containing combustion effluents is becoming critical, particularly since substantially ash-free fuels, such as petroleum distillate fuels, are becoming more scarce and/or more expensive and since residual ash-containing fuels and blends thereof with distillate fuels are more readily available and are relatively less expensive. Moreover, corrosion data indicate that at higher gas turbine operating temperatures, e.g., metal temperatures of 1,700° F., magnesium used at a magnesium:vanadium weight ratio of 3:1 is no longer capable of providing adequate protection with a substantially alkali-freee fuel.

In my above-identified copending, coassigned patent application Ser. No. 281,311, now U.S. Pat. No. 3,817,722 there is disclosed fossil fuel additive compositions, and the use of such additive compositions, made up silicon and magnesium components to control both high temperature corrosion of turbine metal alloys exposed to combustion gases and as modifying agents for the ash produced in the combustion products resulting from the combustion of ash-containing fuels, such as fuels containing one or more of the elements vanadium, an alkali metal, such as sodium, and sulfur. More specifically, in my above-identified patent application, it is disclosed that a marked inhibition of corrosion and ash deposition in fossil fuel burning equipment is achieved by utilizing in the operation of such equipment additive components comprising sources of silicon and magnesium, the proportions being such as to provide a combined $SiO_2$ and MgO ratio equivalent wherein the $SiO_2$:MgO ratio is greater than 2:1. In the combustion of fossil fuels in furnaces, boilers, diesel engines or for use in connection with the operation of gas turbines, it is desirable that the additive components be present in amounts to provide at least 0.05 part by weight combined $SiO_2$ and MgO equivalent to each part by weight of ash in said fuel. Further, in the combustion of ash-containing fuels for use in connection with gas turbine operation, wherein either or both vanadium and alkali metal is present in the combustion products, it is disclosed in my above-identified patent application that the additive components should be present in amounts to provide at least 2 parts by weight of magnesium to every part by weight of vanadium in the fuel with, as indicated hereinabove, the $SiO_2$:MgO ratio of said components being such as to provide at least 2 parts by weight silicon to each part by weight of alkali metal in the fuel and/or in the air associated therewith in the combustion. In my above-identified patent application, it is also mentioned that in connection with the operation of gas turbines it is desirable and economically practical to employ an $SiO_2$:MgO ratio of 6:1 and higher in connection with high sodium fuels.

Accordingly, it is an object of this invention to provide improved fuel compositions.

It is another object of this invention to provide an improved process for the combustion of fuels.

It is another object of this invention to provide improved fuel compositions wherein the alkali metal content of the fuel compositions, such as sodium content, is greater than 5 ppm by weight.

It is still another object of this invention to provide an improved process for the combustion of high sodium content fuels for use in connection with the operation of gas turbines operating at temperatures above 1,400° F., such as 1,700° F., or higher.

It is still another object of this invention to provide useful fuel compositions suitable for use in connection with the operation of gas turbines wherein the fuel compositions might contain up to about 50–100 parts per million by weight alkali metal, e.g., sodium and/or potassium.

Yet another object of this invention is to provide a method of operating gas turbines wherein the hot combustion effluent employed to operate the gas turbine contains a high alkali metal content, such as above about 5 ppm by weight.

How these and other objects of this invention are achieved will become more apparent in the light of the accompanying disclosure. In at least one embodiment of the practice of this invention, at least one of the foregoing objects will be achieved.

In accordance with this invention, it has been discovered that fuels having a high alkali metal (sodium and potassium) content, such as greater than 5 ppm by weight sodium, or distillate fuels substantially free of alkali metal but which are burned or combusted under conditions that alkali metal appears in the combustion products or effluent, are advantageously combusted in the presence of additive components consisting essentially of compounds of silicon and magnesium which form $SiO_2$ and MgO at fuel combustion temperatures, the proportions of said compounds being such as to provide a combined $SiO_2$ and MgO equivalent wherein the $SiO_2$:MgO ratio is greater than 2:1. The quantity of said additive components present during the combustion of fuel is such as to provide a weight ratio of silicon to sodium greater than 6:1 in the combustion products or effluent resulting from the combustion of said fuel in the presence of said additive components and to provide at least 2 parts by weight of magnesium for each part by weight of vanadium present in the fuel.

The additive components may be added to the fuel prior to combustion or may be separately introduced into the combustion zone into contact with the fuel during combustion or directly into the flame or primary hot combustion gases.

The practices of this invention are generally applicable to ash-containing fuels and the combustion of fuels under conditions such that alkali metal appears in combustion products or in the combustion effluents. Fuels which are suitably employed in the practices of this invention include the hydrocarbonaceous fossil fuels, such as the petroleum fossil fuels, especially the normally liquid petroleum fuels, either distillate or residual petroleum fuels. The normally gaseous and liquid distillate fuels tend to be substantially ash-free and for the most part provide a trouble-free fuel for use in connection with gas turbine operation. However, as indicated hereinabove, even substantially ash-free fuels, such as distillate fuels, may present a problem in connection with gas turbine operation if such fuels are combusted or burned under conditions such that the combustion products contain alkali metal therein, as might arise when such fuels have been exposed to salt water contamination and the salt water not adequately removed, or when such fuels are burned or combusted in a maritime or marine installation, such as on board ship or in a harbor or similar location wherein the air employed for the combustion of the fuel might contain finely divided, almost microscopic, salt particles or salt-containing mist, or where water is injected into the combustion chamber as a means of lowering flame temperature to reduce $NO_x$ emissions and wherein the water employed contains a minor amount of ash-forming constituents or metals, such as sodium. The practice of this invention, as indicated hereinabove, is also applicable to gaseous fuels useful for gas turbine operation, such as natural gas, liquefied petroleum gas (LPG), the normally gaseous or readily liquefiable hydrocarbons as well as synthetic liquid and/or gaseous fuels, e.g., CO, $H_2$, $CH_4$, $C_2H_6$ and mixtures thereof prepared by the liquefaction or gasification of solids, such as coal, petroleum coke, combustible waste materials, petroleum residues, liquid petroleum fractions and others.

The additive components silicon and magnesium employed in the practices of this invention to provide a "combined $SiO_2$-MgO equivalent", are varied and numerous. Substantially any compounds or mixtures thereof, consisting essentially of silicon and magnesium, can be employed so long as there is provided $SiO_2$ and MgO at the temperatures involved in the combustion of fuels. The additive silicon and magnesium components may be organic compounds, inorganic compounds or mixtures thereof and such compounds or mixtures thereof can be either water-soluble or water-dispersible or oil-soluble or oil-dispersible, or both. The components can be individually or collectively blended with the fuel prior to burning or introduced to the combustion zone separately of the fuel or any one or more of the above techniques and methods for the introduction of the additive components so as to effect combustion of the fuels in the presence thereof may be employed.

As sources of magnesium or the magnesium component, such readily available compounds as magnesium sulfate, e.g., epsom salt, magnesium acetate and magnesium chloride, all of which are water-soluble, may be employed. The readily available water-insoluble magnesium compounds, such as magnesium hydroxide, magnesium oxide and magnesium carbonate, are also usefully employed, preferably in dispersible or finely divided form. Other magnesium-containing materials or compounds, such as talc, the magnesium clays, natural or synthetic magnesium silicate, which would also supply both magnesium and silicon, are useful. The magnesium-containing organic compounds are also useful, such as the magnesium salts of organic acids, such as the aliphatic, naphthenic and petroleum sulfonic acids, e.g., magnesium petroleum sufonates, magnesium naphthenates, also the magnesium salts of the higher molecular weight carboxylic acids, such as magnesium oleate, magnesium octoate and the like, all of which are useful to contribute the magnesium component of the special additive mixture of silicon and magnesium components in accordance with this invention.

As a source of silicon, finely divided or colloidal silica is useful, as well as the finely divided inorganic silicates. The organic silicon-containing compounds are especially useful, particularly the silicones, the polysilicones, the lower alkyl $C_1$–$C_6$ silicates, such as the tetra-lower-alkyl orthosilicates, the mixed alkyl polysilicates, e.g., the ethyl polysilicates. These silicon-containing compounds usefully provide all or part of the silicon component of the additive admixture consisting essentially of compounds of silicon and magnesium which are capable of forming $SiO_2$ and MgO at fuel combustion temperatures.

The preparation of aqueous solutions and aqueous dispersions containing the additive components of this invention can be effected by any suitable and/or conventional formulating techniques. Similarly, such procedures for preparing organic solvent solutions or suspensions can also be employed. When an additive composition is to be used in distillate and other high grade petroleum fuel, the organic solvent suspensions or solutions can be prepared in various light petroleum fractions, such as kerosene, No. 2 distillate oil and the like. When the additive composition is to be used in lower grade fuel, such as residual oils, the use of an aromatic type solvent or aromatic petroleum fraction is preferred in order to facilitate uniform blending or admixture with the fuel. Suitable aromatic solvents are the relatively high boiling substituted naphtalene or di-substituted benzene compounds. Typical useful aromatic solvents which are commercially available include (1) aromatic solvents which contain methylnaphthalene or naphthalene fractions regardless of origin, that is, whether from coal tar or petroleum sources, (2) methylated naphthalenes, such as mixtures of alpha-methylnaphthalene, and beta-methylnaphthalene, and derivatives thereof, and (3) chlorinated solvents, such as orthodichlorobenzene. Other solvents are also suitable.

The advantages of the practices of this invention can be achieved by a number of different approaches. A primary approach involves the use of the additive components combined or blended with the fuel and wherein the sources of silicon and magnesium are mechanically blended with fuel or fluid preparations of the additive components in either aqueous or organic liquid base in which the magnesium and silicon sources are uniformly dissolved and/or dispersed. Such additive compositions can readily be formulated to satisfy the special requirements of the fuel to be burned and fuel burning equipment.

It is to be understood, however, as indicated hereinabove, that it is by no means necessary that the silicon and magnesium sources be added simultaneously or concurrently. They may be separately introduced to the fuel or to the combustion zone; and if a bulk fuel is provided which contains either the magnesium or silicon component in any appropriate amount, the invention can be practiced by introducing the missing silicon or magnesium source in an amount to provide an $SiO_2$:-MgO ratio greater than 2:1 in the combustion gas.

It may also be desirable when the treated fuel is needed for large installations or a number of small installations that the additive components be incorporated in the fuel by the supplier.

The methods of utilizing the present invention may differ somewhat depending upon the type of fuel burning apparatus involved, i.e., whether the turbine is fired directly with liquid or gas fuels, operated in conjunction with the pressurized boiler in which combusion occurs in the boiler under pressure and the effluent combustion gases introduced into the gas turbine with or without supplemental firing ahead of the turbine, or water injection is employed as hereinabove discussed. In the practice of this invention, the additive components are desirably present in amounts to provide at least 2 parts of weight each of magnesium and silicon to each part by weight of vanadium and sodium, respectively, in said fuel or combustion effluent to the turbine. This proportion can be increased to 3 parts by weight, and higher if desired, as any such increase in the amount of additive components will further improve ash modification and control of corrosion. From a practical standpoint, the upper limit of the amount of additive components is an economical one, with the decision being based on a number of variable factors including, in addition to the cost of the additive, factors such as fuel cost, fuel quality, i.e., ash quantity and composition, and degree of control of corrosion and fouling of turbine hot component parts sought.

When the additive composition or additives are introduced into the combustion zone independently of the fuel, the dosage should generally correspond to the dosage which would be used if combined directly with the fuel.

The operation of gas turbines represents a special situation due to the substantially higher metal temperatures encountered compared to other power generating combustion apparatus. In the combustion of fuel in gas turbine operation, where either or both vanadium and alkali metal will be present in the combustion products, the additive components should be present in amounts to provide at least 2 parts, and preferably about 3 parts, by weight of magnesium to each part of weight of vanadium in said fuel or combustion effluent, with the $SiO_2$:-MgO ratio of said components being such as to provide greater than 6 parts by weight of silicon to each part by weight of alkali metal in said fuel and in the air combining or associated therewith on combustion, and/or introduced by water injection into the combustion zone. For inland installation, it is unlikely that alkali metal will be introduced in the combustion air. On the other hand, with gas turbines used for marine propulsion or in land-based installations close to bodies of salt water, the amount of alkali metal introduced by salt spray in the combustion air can contribute significantly to the amount of alkali metal present in the combustion products.

As has been earlier pointed out, the combination of sulfur, traces of which are almost always present in petroleum fuels, and an alkali metal leads to destructive sulfidation corrosion when gas turbines are operated with such fuels at the temperatures in the range of 1,400°–1,700° F. and higher. Sulfidation, referred to also as hot corrosion, produces a catastrophic deterioration of hot gas-pass alloys used in nozzles and blades of gas turbines by chemical attack of $Na_2SO_4$, either flame-formed or otherwise present in the combustion gas, upon the alloy metal components, such as chromium and nickel, resulting in precipitation of globular metal sulfides, predominantly chromium sulfide, thereby depleting the chromium content of the metal and destroying the oxidation resistance of such alloys. It is important, furthermore, to recognize that this sulfide corrosion is independent of, and unrelated to, the presence of vanadium compounds in the fuel and the resulting corrosion caused by low melting vanadates. The accelerated oxidation and severe exofoliation caused by sulfidation can result in failure of such gas turbine alloys within the relatively short operating period of a few thousand hours.

In the A.S.M.E. publication by C. T. Sims, Paper No. 70-GT-24, presented at the Gas Turbine Conference in Brussels, Belgium, May 24–28, 1970, there is presented a description of the morphological mechanism of sulfidation corrosion of gas turbine nickel alloys. The disclosures of this paper are here incorporated and made part of this disclosure. To minimize or prevent this destructive sulfidation of turbine alloy components, it is necessary to provide additive components according to this invention, desirably with an increased $SiO_2$:MgO ratio, so as to yield an Si:Na weight ratio greater than 6:1. When using additives of the present invention with dosage and $SiO_2$:MgO ratio according to or proportional to the amount of vanadium and alkali metal in the combustion products, the amount of alkali metal in the combustion products can be allowed to be substantially increased, e.g., up to and greater than 20, even 50, or higher, parts per million by weight of alkali metal, without particularly detrimental effect. This can involve substantial economic benefits since the necessity for virtual elimination of the alkali metal from the fuel and/or combustion air as well as from the water injected to reduce nitrogen oxides in the combustion products, all significant cost factors, is reduced or eliminated.

Not only does the use of the combination of magnesium and silicon additives in accordance with the present invention overcome the serious problems of sulfidation corrosion in high temperature gas turbine operation, even when using high grade fuel recommended for such operation, but also the additives permit the use of substantially lower grade fuels in high temperature gas turbine operation.

It is to be understood that additive compositions and fuel compositions in accordance with the present invention may contain other additive components having known beneficial effects in particular fuels. By way of illustration, small amounts of manganese, barium or iron employed for combustion improvement and/or smoke suppression, as well as boron as a biocide and other materials, such as emulsifiers or deemulsifiers, can be present where indicated by the nature of the fuel to be burned. So long as additive compositions and/or treated fuels contain sources of magnesium and silicon and/or there is provided in the combustion effluent or in the hot combustion zone $SiO_2$ and MgO in the proportions, and in the amounts disclosed, such additive compositions and treated fuels involve the practice of the subject invention.

As indicated hereinabove, by employing the practices of this invention, i.e., by incorporating the additive components in alkali metal-containing fuels or by combusting the fuels in the presence of the additive components consisting essentially of silicon and magnesium in an amount to yield a weight ratio of silicon to alkali metal greater than 6:1, preferably greater than 10:1, in the combustion products, any requirement for water washing to remove alkali metal from the fuel is avoided or reduced. Further, as indicated hereinabove, it would be possible by following the practices of this invention to burn fuels under conditions where a high alkali metal content, e.g., up to about 20–100 ppm Na, appears in the combustion products but without resulting undue corrosion or fouling of turbine blades when the combustion products are employed to drive a gas turbine. At present A.S.T.M. gas turbine fuel specifications set limits of 5 ppm sodium and 2 ppm vanadium for GT1, GT2 and GT3 fuels intended to be burned without the need for any additive for either corrosion or ash deposit control. Althouth these fuel specifications were set by turbine manufacturers, industry experience has shown the fuels, even containing these relatively low and previously thought to be acceptable contaminant levels, are wholly unacceptable and result in the rapid destruction of turbine blades in turbines operating with metal temperatures of about 1,400° F. and higher. By employing the fuel compositions and by combusting fuels in accordance with the practices of this invention, these difficulties are avoided.

Further, as indicated hereinabove, by employing the practices of this invention the necessity for water washing of sodium-containing fuels to obtain virtual elimination of the alkali content is obviated. This invention permits employing a relatively simple procedure involving a short, reasonable period of fuel residence time in storage to allow settling and substantial separation of entrained water from the fuel. Such a procedure permits removal of a substantial part of any sea water or aqueous salt solutions which are usually entrained in the fuel, and, with filtering or centrifuging of the fuel, if necessary, would eliminate a high and fluctuating concentration of sodium and would serve to reduce sodium in such fuels to a range of about 10–20 ppm, a sodium level readily handled by this invention. As indicated hereinabove, by employing the practices of the invention it would also be possible to tolerate higher sodium content in the combustion products entering the turbine by way of sea-salt ingestion in the combustion air or, if water injection is employed, to utilize a lesser purity water source without resorting to expensive pretreatments, such as deionization, to essentially eliminate metal contaminants prior to use of the water in the turbine, as long as the sodium level in the hot combustion products did not exceed a maximum of about 20–50 ppm. According to this invention, the sodium content of the fuel or of the combustion products entering the turbine need not be reduced to a negligible level provided there is present during the combustion of the fuel the additive components in accordance with this invention. This discovery is of significant commercial importance and value.

Tests were carried out to demonstrate the utility of the practices of this invention, particularly the addition of the combination of special components of this invention, to a high sodium content fuel. A number of tests using special equipment were conducted on metal specimens simulating conditions to which actual gas turbine blades are exposed. This special equipment is described and illustrated in Paper No. 70-WA/CD-2, an A.S.M.E. paper presented at the Annual Meeting in New York, N. Y., Nov. 30 – Dec. 3, 1970 of The American Society of Mechanical Engineers, entitled "Laboratory Procedures for Evaluating High-Temperature Corrosion Resistance of Gas Turbine Alloys." The metal specimens tested were made of Udimet 500, a nickel alloy containing Co, Cr, Al, and Ti and a cobalt alloy X-45 containing Cu, Ni, and W, all described in the above paper.

The fuel employed in the tests was a fuel oil containing varying amounts of sodium in the range from 1.5 to 20 ppm and varying amounts of vanadium in the range 2 to 20 ppm. The special components of this invention were added to yield various weight ratios of magnesium to vanadium and silicon to sodium. The additive components consisting essentially of compounds of silicon and magnesium which form $SiO_2$ and MgO at the fuel combustion temperature were added in the form of magnesium sulfonate containing 12% by weight MgO and a silicone polymer containing about 60% by weight $SIO_2$, both dissolved in an aromatic petroleum fraction having a boiling point above about 450° F. The amounts of the additives were combined with the fuel to provide the Mg/V and $SiO_2$/MgO ratios indicated in the accompanying Table I which also sets forth the results of the tests. The tests were carried out for a period of about 150 hours, employing a combustion gas temperature of 1,600° F. and at a pressure of approximately 3 atmospheres. The results of these tests are set forth in Table I.

TABLE I

| Fuel Composition | | | Additive Ratios | | Corrosion, Weight Loss Mg/cm² | | |
|---|---|---|---|---|---|---|---|
| V ppm | Na ppm | Na/V Ratio | Mg/V | $SiO_2$/MgO | U500 | X–45 | Sulfidation |
| none | none | — | none | none | 5.5+ | 8+ | none |
| 2 | 2 | 1.0 | none | none | 13 | 13 | none |
| *20 | 1.5 | 0.075 | 3 | none | 4.5 | 10.6 | none |
| 20 | 20 | 1.0 | none | none | catastrophic | | very severe |
| 20 | 20 | 1.0 | 3 | none | not measured | | unacceptable |
| 20 | 20 | 1.0 | 6 | 3 | 7.6 | 17.5 | none |

*Test Temperature of 1,500° F.
+Oxidation

The test data clearly shows that at 1,600° F. even a relatively minor quantity of ash present in the fuel, such as 2 ppm of both vanadium and sodium, causes a significant increase in corrosion, expressed as weight loss of alloy specimens, compared to that occurring when burning a distillate, ash-free fuel under the same test conditions whereby only normal high temperature oxidation occurs. When a magnesium additive is added to a relatively high vanadium content fuel at a weight ratio of 3/1 for Mg/V, vanadium corrosion at 1,500° F. is inhibited at a minimal sodium concentration in the fuel. However, at a high sodium concentration in the fuel, rapid destruction of the alloy metals results despite the presence of magnesium at a normally heretofore recommended weight ratio of 3/1 for Mg/V. In contrast to the ineffectiveness shown by magnesium additive component alone, the combination additive composition of this invention employed with a fuel containing 20 ppm vanadium and 20 ppm sodium, giving a weight ratio of Na/V of 1, completely prevented sulfidation attack under identical conditions and reduced the weight loss of the metal alloy specimens to a level approaching that shown for an ash-free fuel with, in the case of the nickel base alloy, U500, even a reduction in corrosion rate as compared to a fuel containing 2 ppm vanadium and 2 ppm sodium. Previous tests had indicated that 2 ppm V and Na is the maximum concentration of these metals permissible in a fuel for use in high temperature turbine operation without an additive. The most significant benefit derived by use of the additive composition of this invention, however, is the suppression of sulfidation, as shown with a fuel containing an amount of 20 ppm sodium, 20 times greater than the 1 ppm maximum sodium content specified by most turbine manufacturers as a means of avoiding sulfidation of the metal alloys employed in the nozzles and blades of turbines operating at a temperature of about 1,400° F. and higher.

The test results set forth in Table I demonstrate that by employing the special combination of additive components in accordance with this invention, high levels of an alkali metal, such as sodium, can be present in the fuel, much higher than previously considered permissible, provided the fuel is combusted in the presence of the special combination of additive components of this invention, thereby avoiding devastating sulfidation attack upon and excessive corrosion of the blades.

Following are additive compositions or formulations in accordance with this invention. One formulation is made up of about 54% by weight of a petroleum hydrocarbon fraction, such as an aromatic petroleum fraction, about 25% by weight of an organic silicon-containing compound or compounds, such as a silicone, and about 21% by weight of an organic magnesium-containing compound or compounds, such as the magnesium salt of a petroleum sulfonic acid, providing an $SiO_2$/MgO weight ratio of 6:1 and having a total metal oxide content of about 17.5% by weight. This formulation is useful as an additive in connection with the combustion of a normally liquid distillate fuel, such as a normally liquid distillate petroleum fuel, for gas turbine operation. Another formulation useful in connection with the combustion of vanadium-containing fuels, such as vanadium-containing liquid petroleum fuels, for gas turbine operation, comprises in accordance with this invention 34% by weight of a liquid hydrocarbon or petroleum fraction, 25% by weight of an organic silicon-containing compound or compounds and 41% by weight of a magnesium-containing organic compound or compounds, the additive composition providing an $SiO_2$/MgO weight ratio of 3:1 and a total metal oxide concentration of about 20% by weight.

Various substitutions and modifications in the additive compositions, the fuels containing the same and the methods of combusting the fuels in the presence of the additive compositions in accordance with this invention will be apparent to those skilled in the art in the light of the accompanying disclosure.

I claim:

1. A fuel composition for use in gas turbines operating at temperatures of about 1,400° F. and higher comprising a major amount of a combustible fuel having an alkali metal content greater than 2 parts per million by weight and blended therewith additive components in an amount sufficient to inhibit sulfidation and turbine deposits, said additive components consisting essentially of compounds of silicon and magnesium which form $SiO_2$ and MgO at the fuel combustion temperature, the proportions of said compounds being such as to provide a combined $SiO_2$ and MgO equivalent wherein the $SiO_2$:MgO ratio is greater than 2:1, the quantity of said additive components blended with said fuel being such as to provide a weight ratio of silicon to alkali metal in said fuel composition or resulting effluent combustion gas greater than 6:1.

2. A fuel composition in accordance with claim 1 wherein said fuel has a vanadium content greater than 2 parts per million by weight and wherein the amount of said additive components is such as to provide at least 2 parts by weight magnesium for each part by weight vanadium in said fuel.

3. A fuel composition for use in gas turbines operating at temperatures of about 1,400° F. and higher comprising a major amount of petroleum fuel, said petroleum fuel having blended therewith a minor amount of additive components effective to inhibit sulfidation and turbine deposits, said additive components consisting essentially of compounds of silicon and magnesium which form $SiO_2$ and MgO at fuel combustion temperatures, the proportions of said compounds being such as to provide a combined $SiO_2$ and MgO equivalent wherein the $SiO_2$:MgO ratio is greater than 2:1 and wherein the silicon compound is present blended with said fuel so as to provide in the combustion effluent derived from the combustion of said fuel in the presence of an alkali metal-containing compound an amount such that the weight ratio of silicon to alkali metal in said combustion effluent is greater than 6:1.

4. A process for operating a gas turbine at temperatures of about 1,400° F. and higher on a combustible fuel having an alkali metal content in the fuel gas, i.e., greater than 2 parts per million by weight or wherein the fuel is combusted under conditions such that greater than 2 ppm alkali metal appears in the resulting combustion effluent, which comprises combusting said fuel in the presence of additive components in an amount effective to inhibit sulfidation and turbine deposits, said additive components consisting essentially of compounds of silicon and magnesium which form $SiO_2$ and MgO at fuel combustion temperatures, the proportions being such as to provide a combined $SiO_2$ and MgO equivalent wherein the $SiO_2$MgO ratio is greater than 2:1 and the quantity of said additive components is such as to provide an amount of silicon such that the weight ratio of silicon to alkali metal in said combustion effluent is greater than 6:1.

5. A process in accordance with claim 4 wherein said fuel is an ash-containing petroleum fuel having a vanadium content greater than 2 parts per million by weight and wherein the quantity of said additive components is such as to provide at least 2 parts by weight magnesium for each part by weight of vanadium in said fuel.

6. A process for operating a gas turbine at temperatures of about 1,400° F. and higher on a distillate petroleum fuel wherein the alkali metal content in the combustion effluent is greater than 2 ppm, which comprises combusting said fuel in the presence of additive components in an amount to inhibit sulfidation and turbine deposits, said additive components consisting essentially of compounds of silicon and magnesium which form $SiO_2$ and MgO at fuel combustion temperatures, the proportions being such as to provide a combined $SiO_2$ and MgO equivalent wherein the $SiO_2$:MgO ratio is greater than 2:1 and the amount of said additive components is such as to provide an amount of silicon such that the weight ratio of silicon to alkali metal in said combustion effluent is greater than 6:1.

7. A process for operating a gas turbine at temperatures of about 1,400° F. and higher by combusting a vanadium-containing fuel characterized by a sodium content greater than 2 parts per million by weight and wherein said fuel has not been pretreated prior to combustion by water washing and/or electrostatic desalting, to provide an alkali metal content below about 2 parts per million by weight, which comprises combusting said fuel in the presence of an amount of additive components effective to inhibit sulfidation and turbine deposits, said additive components consisting essentially of compounds of silicon and magnesium which form $SiO_2$ and MgO fuel combustion temperatures, the proportions of silicon and magnesium in said additive components being such as to provide a combined $SiO_2$ and MgO equivalent wherein the $SiO_2$:MgO ratio is greater than 2:1 and the quantity of said additive components is such as to provide at least 2 parts by weight of magnesium for each part by weight of vanadium in said fuel and wherein the silicon is present so as to provide in the combustion effluent derived from the combustion of said fuel at weight ratio of silicon to alkali metal greater than about 2:1.

8. A process for operating a gas turbine at temperatures of about 1,400° F. and higher by combusting vanadium and alkali metal-containing fuel which comprises subjecting said fuel to a pretreatment procedure involving fuel storage settling and/or centrifugation and/or passage through coalescing filters for the substantial removal of alkali metal-containing water present in said fuel so as to provide a fuel having an alkali metal content not greater than 50 parts per million by weight and combusting the treated fuel in the presence of an amount of additive components effective to inhibit sulfidation and turbine deposits, said additive components consisting essentially of compounds of silicon and magnesium which form $SiO_2$and MgO at fuel combustion temperatures, the proportions of said silicon and magnesium in said additive components being such as to provide a combined $SiO_2$ and MgO equivalent wherein the $SiO_2$:MgO ratio is greater than 2:1 and the quantity of said additive components being such as to provide at least 2 parts by weight of magnesium for each part by weight of vanadium in said fuel and to provide in the combustion effluent resulting from the combustion of said fuel an amount of silicon such that the weight ratio of silicon to alkali metal in said combustion effluent is greater than 10:1.

9. A method of combusting a petroleum fuel for the operation of a gas turbine wherein the hot combustion effluent resulting from the combustion of said fuel is employed to operate said gas turbine and wherein in the combustion of said fuel alkali metal appears in the combustion effluent, said alkali metal being present in said combustion effluent in an amount in the range from about 2 parts per million by weight up to about 50 parts per million by weight, which comprises combusting said fuel in the presence of an amount of additive components effective to inhibit sulfidation and turbine deposits upon the operation of said turbine at a temperature of about 1,400° F. and higher, said additive components consisting essentially of a material which contains silicon and magnesium and which form $SiO_2$ and MgO at fuel combustion temperatures, the proportions of silicon and magnesium in said additive components being such as to provide a combined $SiO_2$ and MgO equivalent wherein the $SiO_2$:MgO ratio is greater than 2:1, wherein the quantity of said additive components is such as to provide at least 2 parts by weight magnesium for each part by weight of any vanadium in said fuel and wherein silicon is present to provide in the combustion effluent derived from the combustion of said fuel an amount of silicon such that the weight ratio of silicon to alkali metal in said combustion effluent is greater than 6:1.

10. An additive composition useful for incorporation in liquid hydrocarbon fuels employed for the operation of gas turbines at temperatures of about 1400° F. and higher, said additive composition being useful for inhibiting corrosion and ash deposition, comprising sources of silicon and magnesium, the quantities of said sources of silicon and magnesium being such as to provide a combined $SiO_2$ amd MgO equivalent at the combustion temperature wherein the $SiO_2$:MgO ratio is greater than 2:1, said magnesium source being selected from the group consisting of magnesium acetate, magnesium chloride, magnesium sulfonate, magnesium naphthenate, magnesium petroleum sulfonate and the magnesium salts of the higher molecular weight carboxylic acids and said silicon source being selected from the group consisting of $C_1$–$C_6$ alkyl silicates, alkyl polysilicates and a silicone, said silicon and magnesium sources being oildispersible or oil-soluble.

11. An additive composition in accordance with claim 10 wherein the $SiO_2$:MgO ratio is greater than 3:1.

12. An additive composition in accordance with claim 10 wherein said magnesium source is a magnesium sulfonate and wherein said silicon source is a silicone.

13. An additive composition in accordance with claim 12 wherein said magnesium sulfonate contains about 12% by weight MgO.

14. An additive composition in accordance with claim 12 wherein said silicone contains about 60% by weight $SiO_2$.

15. A fuel composition for use in gas turbines operating at temperatures of about 1400° F. and higher comprising a major amount of a liquid hydrocarbon fuel having an alkali metal content greater than 2 parts per million by weight and blended therewith a minor amount of additive components sufficient to inhibit sulfidation and turbine deposits, said additive components being hydrocarbon dispersible or hydrocarbon soluble and consisting essentially of compounds of silicon and magnesium which form $SiO_2$ and MgO at the fuel combustion temperature, said magnesium compound being selected from the group consisting of magnesium acetate, magnesium chloride, magnesium sulfonate, magnesium naphthenate, magnesium petroleum sulfonate and the magnesium salts of the higher molecular weight carboxylic acids and said silicon compound being selected from the group consisting of $C_1$–$C_6$ alkyl silicates, alkyl polysilicates and a silicone, the proportions of said compounds being such as to provide a combined $SiO_2$ and MgO equivalent wherein the $SiO_2$:MgO ratio is greater than 2:1, the quantity of said additive components blended in said fuel being such as to provide a weight ratio of silicon to alkali metal in said fuel or resulting effluent combustion gas greater than about 2:1.

16. A liquid fuel composition in accordance with claim 15 wherein said magnesium compound is a magnesium sulfonate.

17. A liquid fuel composition in accordance with claim 16 wherein said magnesium sulfonate contains about 12% by weight MgO.

18. A liquid fuel composition in accordance with claim 15 wherein said silicon compound is a silicone.

19. A liquid fuel composition in accordance with claim 18 wherein said silicone contains about 60% by weight $SiO_2$.

20. A liquid fuel composition in accordance with claim 15 wherein said fuel composition contains an ash-containing liquid hydrocarbon fuel and wherein said magnesium and silicon compounds are present in said fuel composition to provide at least 0.05 part by weight of combined $SiO_2$ and MgO equivalent to each part by weight of ash in said liquid hydrocarbon fuel.

* * * * *